US005871045A

United States Patent [19]

Hirth et al.

[11] Patent Number: 5,871,045

[45] Date of Patent: Feb. 16, 1999

[54] HEAT EXCHANGER

[75] Inventors: Markus Hirth, Düsseldorf; Wilhelm Bruckmann, Oberhausen, both of Germany

[73] Assignee: BDAG Balcke-Dürr Aktiengesellschaft, D-40882 Ratingen, Germany

[21] Appl. No.: 673,083

[22] Filed: Jul. 1, 1996

[51] Int. Cl.[6] ..... F28F 9/22

[52] U.S. Cl. ..... 165/160; 165/163; 165/157; 165/82; 165/DIG. 427; 165/DIG. 440; 165/DIG. 55; 165/DIG. 54

[58] Field of Search ..... 165/145, 157, 165/160, 163, 69, 164, DIG. 440, DIG. 427, 81, 82, DIG. 55, DIG. 54

[56] References Cited

U.S. PATENT DOCUMENTS

| | | | |
|---|---|---|---|
| 1,926,494 | 9/1933 | Morterud | 165/160 |
| 2,199,216 | 4/1940 | Conti . | |
| 2,566,976 | 9/1951 | Bernstrom | 165/163 |
| 2,967,515 | 1/1961 | Hofstede et al. | 165/145 |
| 2,988,335 | 6/1961 | Disinger et al. | 165/157 |
| 3,101,930 | 8/1963 | Huet | 165/145 |
| 3,240,675 | 3/1966 | Weber | 165/163 |
| 3,379,244 | 4/1968 | Gilli | 165/163 |
| 3,404,731 | 10/1968 | Cushman | 165/163 |
| 3,504,737 | 4/1970 | Charcharos . | |
| 3,749,166 | 7/1973 | Vestre . | |
| 3,991,823 | 11/1976 | Litke et al. | 165/163 X |
| 4,314,606 | 2/1982 | Müller et al. . | |
| 4,528,733 | 7/1985 | Lord . | |
| 4,706,742 | 11/1987 | Ganzer | 165/160 X |
| 5,159,897 | 11/1992 | Franke et al. . | |
| 5,379,832 | 1/1995 | Dempsey | 165/160 X |
| 5,419,392 | 5/1995 | Maruyama | 165/163 |
| 5,533,362 | 7/1996 | Cook et al. | 165/163 X |

FOREIGN PATENT DOCUMENTS

| | | |
|---|---|---|
| 0203445 | 12/1986 | European Pat. Off. . |
| 0442795 | 8/1991 | European Pat. Off. . |
| 0611879 | 8/1994 | European Pat. Off. . |
| 1351602 | 12/1962 | France . |
| 1501681 | 6/1969 | Germany . |
| 2549112 | 4/1977 | Germany . |
| 3012961 | 10/1981 | Germany . |
| 3508382 | 9/1986 | Germany . |
| 3832001 | 4/1990 | Germany . |
| 3921485 | 1/1991 | Germany . |
| 4142375 | 7/1993 | Germany . |
| 4213023 | 10/1993 | Germany . |
| 683019 | 12/1993 | Switzerland . |
| 9313378 | 7/1993 | WIPO . |

*Primary Examiner*—John Rivell
*Assistant Examiner*—Christopher Atkinson
*Attorney, Agent, or Firm*—Robert W. Becker & Associates

[57] ABSTRACT

A heat exchanger has a container with an outer mantle and pipes positioned in the container for conveying a heat-receiving medium through the container. The heat-transferring medium flows exterior to the pipes in counter flow to the heat-receiving medium in the pipes. A common inlet tube is connected to the container and communicates with the pipes for introducing the heat-receiving medium. A common outlet tube is connected to the container and communicates with the pipes for removing the heat-receiving medium from the pipes. The pipes extend meander-shaped within the container. The common inlet tube penetrates the outer mantle on opposite sides and has an inflow end and a remote end. The inflow end is pressure-tightly connected to the outer mantle. The common outlet tube penetrates the outer mantle on opposite sides and has an outflow end and a remote end. The outflow end is pressure-tightly connected to the outer mantle. First and second receiving chambers are pressure-tightly connected to the exterior of the outer mantle. The remote end of the common inlet tube is received in the first receiving chamber and the remote end of the common outlet tube is received in the second receiving chamber.

5 Claims, 3 Drawing Sheets

HEAT EXCHANGER

BACKGROUND OF THE INVENTION

The present invention relates to a heat exchanger, especially for devices operated with great load and/or temperature changes, for example, as a cooling air cooling device for gas turbines, with tubes for separating the heat-transferring medium, especially air, and the heat-receiving medium, especially water. The heat exchange is carried out in counter flow. The flow channels for the heat-receiving medium in the form of tubes extend meander-shaped between a common inlet pipe and a common outlet pipe, and the heat-transferring medium flows along the exterior of the meander-shaped tubes.

The cooling of gas turbine blades is carried out conventionally with an air stream which is often branched off the compressed combustion air for the gas turbine furnace chamber as a partial air stream. The heat energy that has been introduced into the partial air stream by compression must be removed from the air stream before being guided to the gas turbine blades in a cooling air cooling device. Due to frequent start-up and shut-down operations as well as due to the high pressure and temperature differences, this heat exchanger is subjected to extreme load changes which may result in a premature failure of the heat exchanger. A cooling air cooler of the aforementioned kind is known from European document 0 203 445. In this heat exchanger the common inlet and outlet pipes are fixedly connected with the clean gas inlet, respectively, clean gas outlet lines so that load changes and the resulting stress can be compensated only to an insufficient degree.

A further cooling air cooler for gas turbines is known from German Offenlegungsschrift 41 42 375.5. In this known heat exchanger, massive tube plates serve to partition the air-filled chambers from a chamber containing a heat-receiving medium. The air to be cooled is guided through tubes that connect the massive tube plates at the upper and lower end of the heat exchanger and that are fixedly mounted therein. For compensation of the occurring pressure and temperature stresses in these known heat exchangers, one of the massive tube plates is clamped only at one side so that pressure and temperature stresses can be compensated to a certain extent. Furthermore, the outer mantle of the heat exchanger is provided with bellows-type compensators for damping occurring length changes. This known heat exchanger allows to a certain extent a compensation of the pressure and temperature fluctuations resulting from frequent and fast load changes; however, the rigid clamping of the heat exchanger tubes between the two massive tube plates prevents an effective damping of these stresses. Furthermore, the use of the massive tube plates is disadvantageous due to their high weight and their inflexibilty relative to temperature stresses.

It is therefore an object of the present invention to improve a heat exchanger of the aforementioned kind such that the resulting frequent and fast load changes and the resulting pressure and temperature fluctuations can be compensated in a secure and reliable manner. Furthermore, the heat exchanger should be inexpensive to manufacture.

SUMMARY OF THE INVENTION

The heat exchanger of the present invention is primarily characterized by:

A container with an outer mantle;

Pipes positioned within the container for conveying a heat-receiving medium through the container, wherein a heat-transferring medium flows exterior to the pipes in counter flow to the heat-receiving medium in the pipes;

A common inlet tube connected to the container and communicating with the pipes for introducing the heat-receiving medium into the pipes;

A common outlet tube connected to the container and communicating with the pipes for removing the heat-receiving medium from the pipes;

The pipes extending meander-shaped within the container;

The common inlet tube having an inflow end and a remote end, the common inlet tube penetrating the outer mantle on opposite sides, wherein the inflow end is connected in a pressure-tight manner to the outer mantle;

The common outlet tube having an outflow end and a remote end, the common outlet tube penetrating the outer mantle on opposite sides, wherein the outflow end is connected in a pressure-tight manner to the outer mantle;

A first receiving chamber and a second receiving chamber connected in a pressure-tight manner to an exterior of the outer mantle;

The remote end of the common inlet tube received in the first receiving chamber; and The remote end of the common outlet tube received in the second receiving chamber.

Advantageously, the heat exchanger further comprises an inlet socket connected to the container for introducing the heat-transferring medium into the container. The heat exchanger further comprises an inner housing positioned in the container and enclosing the pipes. The inner housing has a first end and a second end wherein the first end is connected to the inlet socket and the second end is open. The inner housing provides a flow channel for the heat-transferring medium.

Advantageously, the heat exchanger further comprises an outlet socket connected to the container in the vicinity of the common outlet tube for removing the heat-transferring medium from the container. Between the inner surface of the outer mantle and the outer surface of the housing a circumferential intermediate space is defined.

Advantagesouly, the surfaces of the heat exchanger in contact with the heat-transferring medium consist of austenitic steel.

Preferably, the heat-receiving medium is water. The heat exchanger preferably functions as a device such as a preheater, an evaporator, a superheater, a preheater/evaporator unit, an evaporator/superheaterunit, or a preheater/evaporator/superheater unit.

According to the present invention, the common inlet or outlet tubes penetrate the outer mantle of the heat exchanger on opposite sides whereby the common inlet/outlet tubes are connected in a pressure-tight manner with their respective inflow or outflow end to the outer mantle. The respective opposite end is guided in a receiving chamber that is pressure-tightly connected to the outer mantle of the heat exchanger.

Due to this elastic support of the common inlet or outlet tubes an additional compensation of the resulting load change stresses is possible because the common inlet/outlet tubes are at least on one end not rigidly connected to the outer mantle of the heat exchanger. Instead the common inlet/outlet tubes can expand into the receiving chamber. Such an expansion in the transverse direction of the heat exchanger does not result in additional stress within the heat exchanger tubes since they are elasticcally mounted.

Furthermore, due to the penetration of the outer mantle of the heat exchanger by the common inlet/outlet pipes it is possible that in the case of leakage a clogging or shut-off of individual heat exchanger tubes from the exterior is possible in a simple manner. By embodying the flow channels for the heat-receiving medium as meander-shaped pipes extending between the two common inlet/outlet tubes, an especially simple and effective compensation of the resulting pressure and temperature fluctuations can be obtained because the meander-shaped bundles of pipes act together as a large spring. The meander-shaped heat exchanger pipes thus are able to compensate occurring load changes without the risk of excessive stress.

According to a preferred embodiment of the invention the meander-shaped pipes are surrounded by an inner housing that is open at one end and is connected with the other end to the inlet socket for the heat-transferring medium. This inner housing provides a flow channel for the heat-transferring medium. By providing this inner housing, the medium to be cooled is guided in a forced manner along the meander-shaped heat exchanger pipes so that the medium to be cooled cannot flow laterally past the heat-exchanger pipes directly to the outlet socket.

In order to enable that the outer mantle of the heat exchanger does not come into direct contact with the medium to be cooled, which has a temperature of up to 500° C., a circumferential intermediate space is provided between the outer mantle of the heat exchanger and the inner housing surrounding the pipes and the outlet socket for the heat-transferring medium is arranged in the vicinity of the common outlet tube. By providing such an intermediate space between the outer mantle and the inner housing a direct heat transfer to the outer mantle of the heat exchanger is prevented. This insulation of the outer mantle relative to the high inlet temperatures of the medium to be cooled can be further improved by arranging the outlet socket in the vicinity of the common outlet tube and thus also in the vicinity of the inlet socket for the heat-transferring medium so that the medium cooled by flowing along the heat exchanger pipes before exiting the heat exchanger has passed through the entire intermediate space between the housing and the outer mantle. This also further assists in providing insulation of the outer mantle.

In order to ensure a good temperature resistance and, furthermore, to ensure that the medium to be cooled is not contaminated, the surfaces that are in contact with the heat-transferring medium consist preferably of austenitic steel.

A further important aspect of the invention is that the heat exchanger when containing water as the heat-receiving medium, can be used as a preheater, evaporator, superheater, preheater with evaporator, evaporator with superheater or preheater with evaporator and superheater. Due to this multitude of operational modes with which the inventive heat exchanger can be operated, the heat exchanger, as a function of the respective pressure and temperature conditions, can be used in many applications without retrofitting.

BRIEF DESCRIPTION OF THE DRAWINGS

The object and advantages of the present invention will appear more clearly from the following specification in conjunction with the accompanying drawings, in which.

DESCRIPTION OF PREFERRED EMBODIMENTS

The present invention will now be described in detail with the aid of a specific embodiment utilizing FIGS. 1 through 3.

Figure 1:
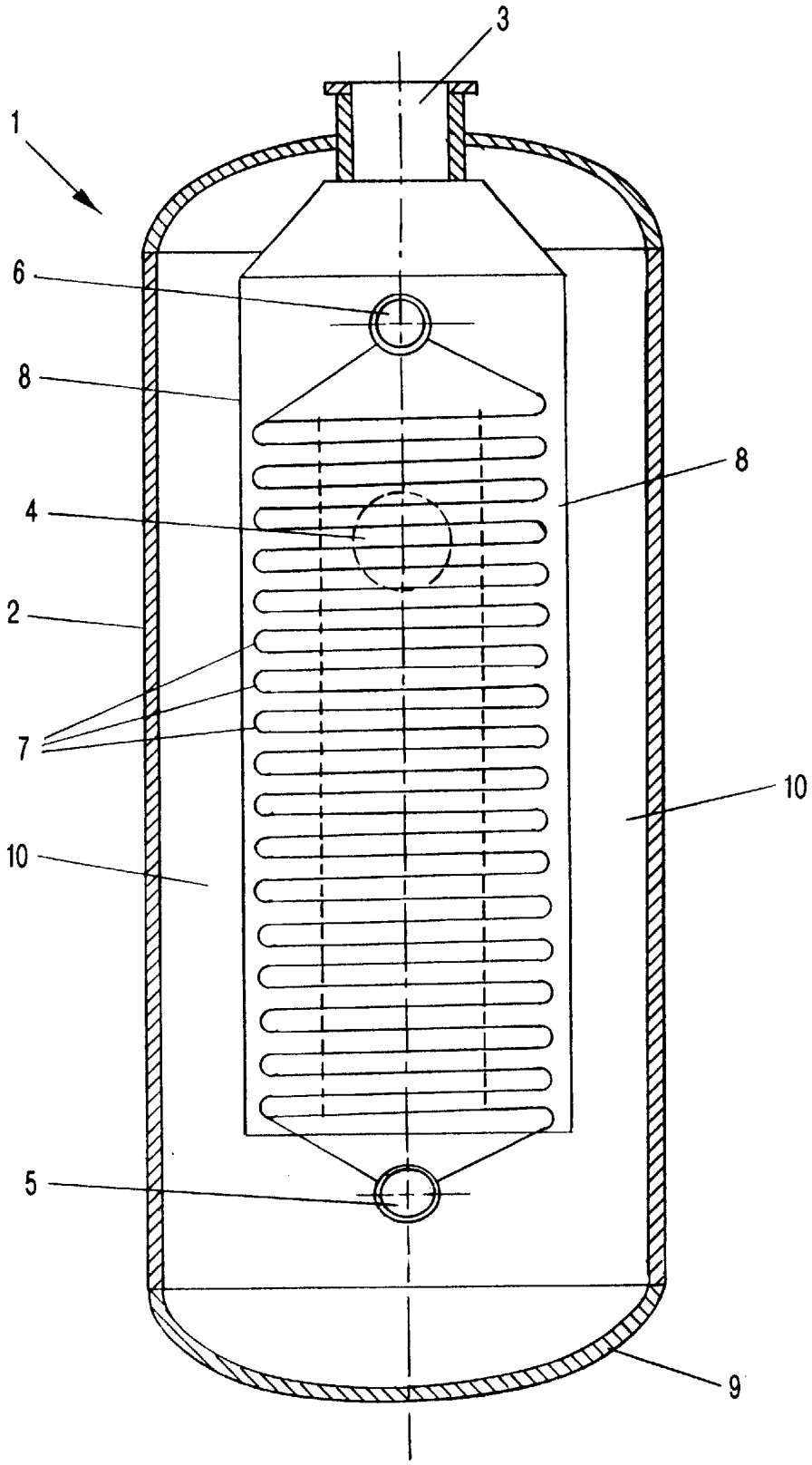
FIG. 1 shows a longitudinal section of a heat exchanger.
Figure 2:
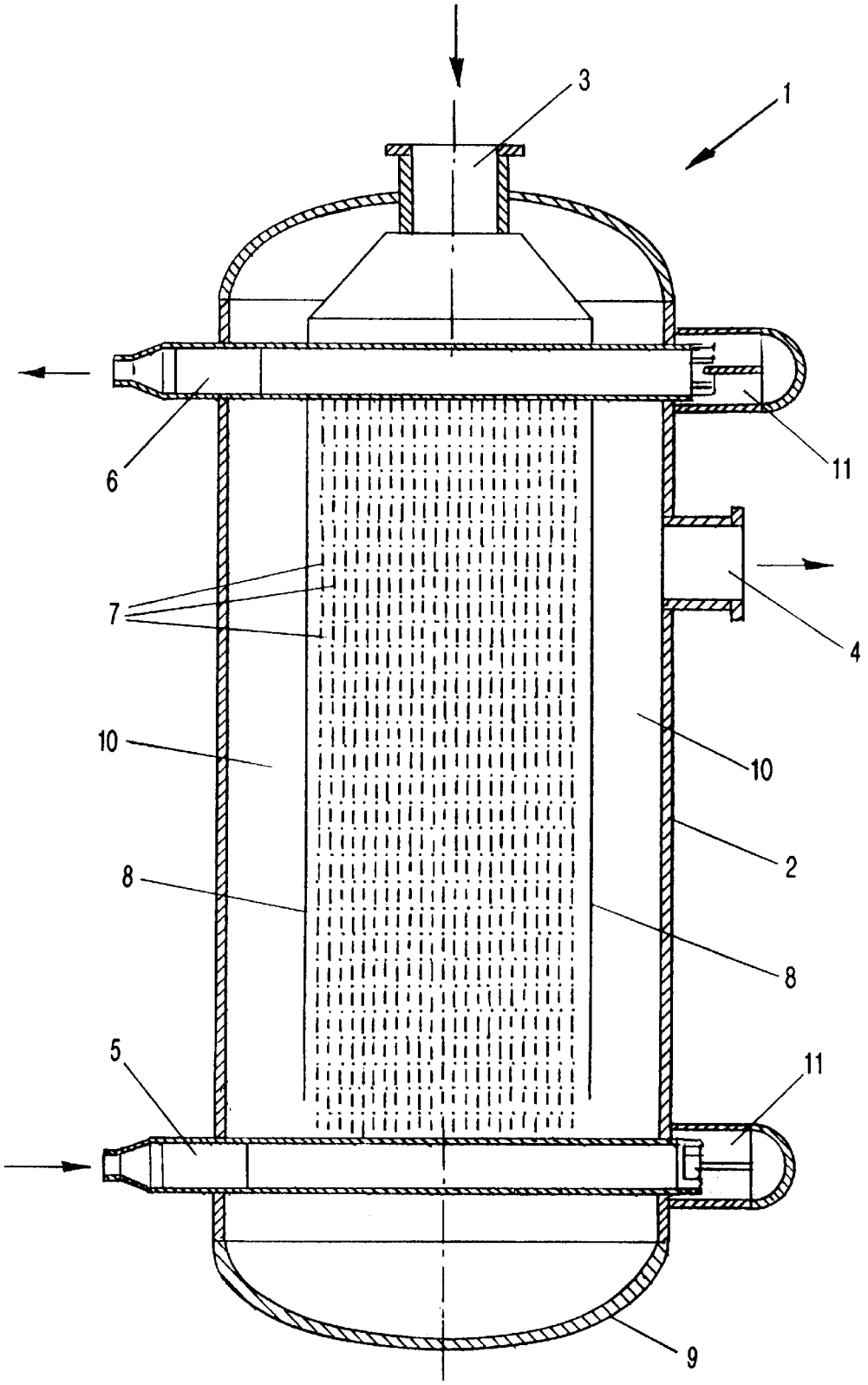
FIG. 2 shows a longitudinal section of the heat exchanger of FIG. 1 rotated by 90° about its longitudinal axis.
Figure 3:
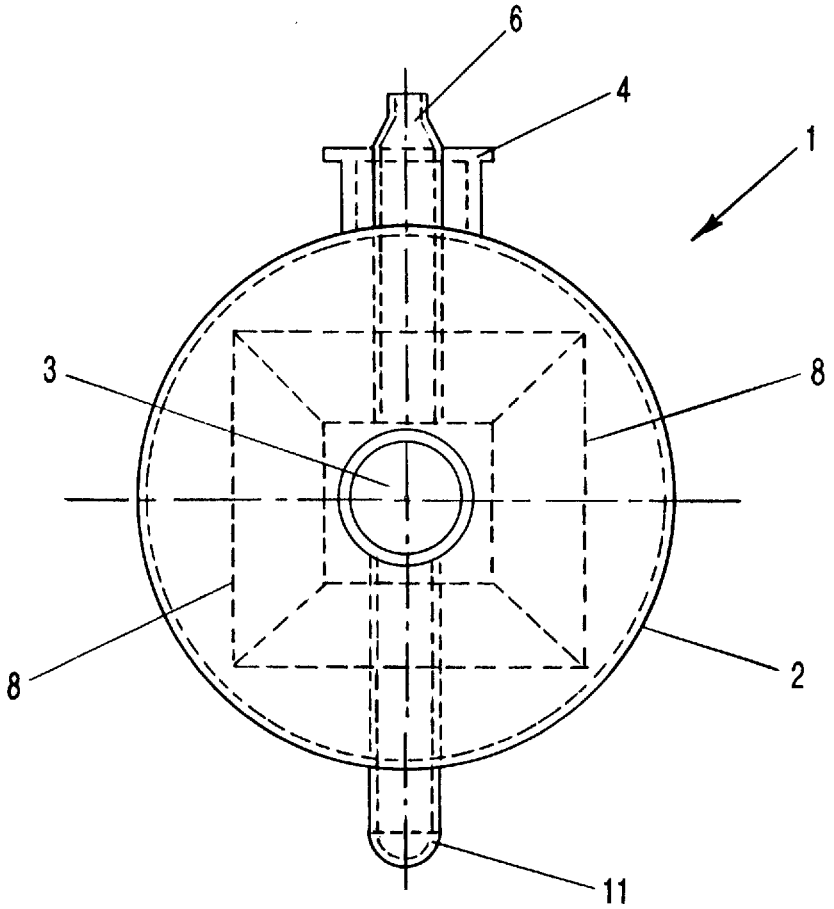
FIG. 3 shows a plan view of the heat exchanger of FIGS. 1 and 2.

FIGS. 1 and 2 show schematically a heat exchanger 1, comprised of a welded outer mantle 2 with an inlet socket 3 and an outlet socket 4 for the heat-transferring medium as well as a common inlet tube 5 and a common outlet tube 6 for the heat-receiving medium. The common inlet tube 5 and the common outlet tube 6 are connected with one another by meander-shaped pipes 7.

In order to ensure that the medium to be cooled, entering through the inlet socket 3, flows along the heat exchanger pipes 7, these pipes 7 in their axial direction are surrounded by a housing 8 which is open at one end and connected with the other end to the inlet socket 3. The arrows shown in FIG. 2 indicate the direction of flow of the heat-transferring and heat-receiving media in the heat exchanger 1. The heat-transferring medium flows through the inlet socket 3 into the heat exchanger 1 and is guided by the inner housing 8 which forms a flow channel from the top to the bottom for the heat-transferring medium along the pipes 7. The pipes 7 are filled with the heat-receiving medium, and this medium flows from the bottom to the top. After exiting the housing 8, the now cooled medium is deflected in the shown embodiment by the bottom 9 of the heat exchanger 1 and flows within the intermediate space formed between the outer mantle 2 of the heat exchanger 1 and the inner housing 8 until the medium exits the heat exchanger 1 via the outlet socket 4. The outlet socket 4 in the shown embodiment is arranged in the vicinity of the common outlet tube 6 so that the now cooled medium flows along almost the entire axial extension of the outer mantle 2 and thereby insulates it against the heat of the non-cooled inflowing heat-transferring medium.

The heat-receiving medium, especially water, flows through the common inlet tube 5 into the heat exchanger 1 and passes therethrough from the bottom to the top within the meander-shaped pipes 7 before it exits the heat exchanger 1 after entering the common outlet tube 6. With this represented flow scheme the heat-transferring and the heat-receiving media are guided for an especially effective heat exchange in a crossed counter flow.

Since especially for the use of such a heat exchanger 1 as a cooling air cooler for gas turbines, the heat exchanger 1 is subjected to a great number of load and/or temperature changes, it is necessary that the heat exchanger 1 as well as all components mounted therein can compensate such changes in an effective manner. For this purpose, the common inlet and outlet tubes 5, 6 as well as the thin-walled pipes connecting the common tubes 5, 6 are elastically suspended and the common tubes 5, 6, in contrast to the prior art in the form of tube plates, are of a thin-walled construction.

The elastic suspension of the common inlet tube 5 and the common outlet tube 6 has the following design. Each of the common pipes penetrates the outer mantle of the heat exchanger on opposite sides whereby the common tubes 5, 6 at their inflow end, respectively, outflow end are connected to the outer mantle 2 in a pressure-tight manner. The respective opposite (remote) ends are guided into a receiving chamber 11 which is pressure-tightly connected to the outer mantle 2. Due to this elastic mounting of the common tubes 5, 6 at the outer mantle 2 of the heat exchanger 1, the common tubes 5, 6 are able to compensate resulting load changes and their stresses. In order to prevent unacceptable stress, resulting from load changes as well as the elastic support of the common tubes 5, 6 within the pipes that connect the common tubes 5, 6, the pipes 7 are arranged in a meander shape between the common inlet tube 5 and the common outlet tube 6 so that the entire bundle of pipes 7 is spring-elastic and resulting stress can be effectively compensated.

The present invention is, of course, in no way restricted to the specific disclosure of the specification and drawings, but also encompasses any modifications within the scope of the appended claims.

What is claimed is:

1. A heat exchanger comprising:

a container with an outer mantle;

pipes positioned within said container for conveying a heat-receiving medium through said container, wherein a heat-transferring medium flows exterior to said pipes in counterflow to the heat-receiving medium in said pipes;

a common inlet tube connected to said container and communicating with said pipes for introducing the heat-receiving medium into said pipes;

a common outlet tube connected to said container and communicating with said pipes for removing the heat-receiving medium from said pipes;

said pipes extending meander-shaped within said container;

said common inlet tube having an inflow end and a remote end, said common inlet tube penetrating said outer mantle on opposite sides, wherein said inflow end is connected in a pressure-tight manner to said outer mantle;

said common outlet tube having an outflow end and a remote end, said common outlet tube penetrating said outer mantle on opposite sides, wherein said outflow end is connected in a pressure-tight manner to said outer mantle;

a first receiving chamber and a second receiving chamber connected in a pressure-tight manner to an exterior of said outer mantle;

said remote end of said common inlet tube received in said first receiving chamber; and said remote end of said common outlet tube received in said second receiving chamber.

2. A heat exchanger according to claim 1, further comprising:

an inlet socket connected to said container for introducing the heat-transferring medium into said container; and an inner housing positioned in said container and enclosing said pipes, said inner housing having a first end and a second end, wherein said first end is connected to said inlet socket and wherein said second end is open, wherein said inner housing provides a flow channel for the heat-transferring medium.

3. A heat exchanger according to claim 2, further comprising an outlet socket connected to said container in the vicinity of said common outlet tube for removing the heat-transferring medium from said container, wherein between an inner surface of said outer mantle and an outer surface of said housing a circumferential intermediate space is defined.

4. A heat exchanger according to claim 1, wherein surfaces of said heat exchanger in contact with the heat-transferring medium consist of austenitic steel.

5. A heat exchanger according to claim 1, wherein the heat-receiving medium is water and wherein said heat exchanger functions as a device selected from the group consisting of a preheater, an evaporator, a superheater, a preheater/evaporator unit, an evaporator/superheater unit, and a preheater/evaporator/superheater unit.

* * * * *

UNITED STATES PATENT AND TRADEMARK OFFICE

CERTIFICATE OF CORRECTION

PATENT NO. : 5,871,045

DATED : Feb. 16, 1999

INVENTOR(S) : Markus Hirth, et al

It is certified that error appears in the above-identified patent and that said Letters Patent is hereby corrected as shown below:

On title page, insert item

[30] Foreign Application Priority Data

July 1, 1995 [DE] Germany.....295 10 720.0

Signed and Sealed this

Tenth Day of August, 1999

*Attest:*

Q. TODD DICKINSON

*Attesting Officer*

*Acting Commissioner of Patents and Trademarks*